US006336857B1

(12) United States Patent
McBride

(10) Patent No.: US 6,336,857 B1
(45) Date of Patent: Jan. 8, 2002

(54) METHOD FOR PLAYING TWO CASINO GAMES AND A METHOD AND AN APPARATUS FOR RELATED PROGRESSIVE JACKPOT

(75) Inventor: Scott McBride, Marie (CA)

(73) Assignee: Gaming Concepts Inc. (CA)

( * ) Notice: Subject to any disclaimer, the term of this patent is extended or adjusted under 35 U.S.C. 154(b) by 0 days.

(21) Appl. No.: 09/357,386

(22) Filed: Jul. 20, 1999

(51) Int. Cl.[7] ..... A63F 1/00
(52) U.S. Cl. ..... 463/12; 273/274; 273/307
(58) Field of Search ..... 463/12; 273/293, 273/303, 307, 274, 20

(56) References Cited

U.S. PATENT DOCUMENTS 5,364,104 A 11/1994 Jones et al.
5,472,194 A 12/1995 Breeding et al.
5,584,485 A 12/1996 Jones et al.

FOREIGN PATENT DOCUMENTS

CA 2125689 7/1994

*Primary Examiner*—Benjamin H. Layno
*Assistant Examiner*—Vishu K Mendiratta
(74) *Attorney, Agent, or Firm*—G. Ronald Bell & Associates

(57) ABSTRACT

The invention relates to an electronic side bet progressive jackpot gaming table apparatus including a color-coded player's banking center which includes a coin slot an electronic button means, a digital display means. The apparatus also includes a dealer key pad having a plurality of electronic button means for the dealer to suitably conduct a side bet progressive jackpot game. The invention furthermore relates to a method of operating the electronic side bet progressive jackpot gaming table apparatus. In addition, methods of playing casino Blackjack games employing an inventive deck of same color-coded playing cards are disclosed.

10 Claims, 3 Drawing Sheets

METHOD FOR PLAYING TWO CASINO GAMES AND A METHOD AND AN APPARATUS FOR RELATED PROGRESSIVE JACKPOT

FIELD OF THE INVENTION

This invention relates to methods for playing casino games and an electronic side bet progressive jackpot gaming apparatus and method.

BACKGROUND OF THE INVENTION

A progressive jackpot played with live casino card games is known. For instance, U.S. Pat. No. 5,364,104 (Jones et al.) describes an arrangement whereby players may take part in a progressive jackpot by placing side bets into token slots. In addition, U.S. Pat. No. 5,472,194 (Breeding et al.) describes an electric network whereby a progressive jackpot game may be linked by multiple gaming tables at multiple facilities.

Heretofore, players wishing to participate in card game progressive jackpots were required to insert one or more tokens into a slot usually located near the player. There is usually an indicating means, such as a LED display to inform the dealer that a particular player is taking part in a side bet. However, the use of tokens has many disadvantages, in particular it takes away token circulation from the casino, it increases the need to replenish the dealer's token bin, K necessitates the player to physically insert a token every time a side bet is placed, and it takes up playing time when the dealer pays out winning tokens to players.

Accordingly, it would be advantageous and time-saving to eliminate the need for tokens in progressive jackpot side bet games. Furthermore, it would also be advantageous for the dealer to interact with the players, such as paying out winning players without involving the physical handling of tokens.

Popular card games such as Blackjack (also known as Twenty-One) are commonly played at casino game tables. However, the Twenty-One card game has been played virtually unchanged through the years. It is desirable to introduce a variation to the winning possibilities for the players. This will not only increase the payers' chances of winning, but also enhance the level of excitement around the gaming table.

Besides taking part in a normal wager, a player may participate in a side bet progressive jackpot. Depending on the card arrangements, a player who is dealt a set of predetermined cards wins either all or a portion of the jackpot. In this connection, U.S. Pat. No. 5,364,105 (Jones) discloses different predetermined "winning hand" cards in a Twenty-One game which will entitle a player to win the progressive jackpot. Similarly, U.S. Pat. No. 5,584,485 (Jones et al.) describes additional predetermined winning hand' cards with Twenty-One, and poker games such as Stud Poker, Draw Power or Lo-Ball Poker.

It will be of interest to progressive jackpot Twenty-One players to experience other kinds of side bet winning possibilities. One such possibility is a predetermined card combination which employs colour-coded playing cards. If a player is dealt a set of colour-coded cards which matches any one of the predetermined arrangements, then the player will win either all or a portion of the jackpot.

Furthermore, it will be of even greater interest to progressive jackpot Twenty-One players if someone who plays the side bet wins the jackpot and all players at the same gaming table who also played the side bet would be entitled to an equal or lesser share of the jackpot winnings.

SUMMARY OF THE INVENTION

The method and apparatus of the present invention comprise a gaming table top suitable for progressive jackpot side betting and ways to accomplishing same. The invention provides a gaming table top having one or more gaming stations for individual players. The station of each individual player is colour co-ordinated. For instance, there can be seven stations with each station bearing a different colour-code wagering area. Each player has a player's banking centre in the vicinity of his/her wagering area. The bank allows the player to accumulate gaming dollars to play the progressive side betting. For each hand of the game the player wishes to take part in the side bet, one dollar will be deducted from the players bank. If a player who participates in the side bet wins, the dealer can conveniently electronically "deposit" the players share of winning dollars into his/her bank The gaming table is provided with a large progressve alphanumeric LED display in the middle, the location of which allows all the players to deafly view the display. The LED display enables the house to show the amount of the accumulative jackpot at every hand. Additional messages can also be keyed into the display directed towards the players.

The gaming table also includes a command centre key pad for use by the dealer to interact with each player electronically, including withdrawing form and crediting to a player's bank. The key pad comprises other control buttons such as Start Hand and End Hand buttons, confirm and cancel buttons etc. The dealer may use any of these buttons to control the flow of the game, as well as to interact with individual players.

The sequence of actions during the betting and playing of the hands according to this invention typically consists of.

- players wager on the casino game (e.g. Blackjack) and making side bets for the progressive jackpot;
- the dealer starts the round of play by pressing the Start Hand button;
- cards are dealt to all players who have made a wager and to the dealer;
- the hands of the players are finalised one at a time starting with the first player and proceeding sequentially therefrom in a clockwise direction;
- a player's wager is collected or that player is paid winnings if it can be determined at that time whether the player has won or lost;
- the dealer's hand is finalised once the hands of all the players have been finalised;
- each player's wager is collected or winnings are paid depending on whether the player has won or lost,
- a determination is made as to whether or not a Specialty Hand has occurred during the round and any winners are paid according to the type of Specialty Hand that has occurred;

the dealer ends the round of play by pressing the End Hand button.

The method of playing an enhanced variation of Twenty-One of the present invention involves a playing method called "Color It Up"™. This is similar to traditonal Twenty-One played in casinos. The game consists of one or more players and a dealer who deals the cards for the house. The playing cards used are special cards designed for this game—each deck of fifty two cards is entirely one colour on the face side, thirteen of each suit. Multiple colour-coded cards may also be used. Besides the traditional blackjack winnings, a player also wins his hand i his cards fall into one of many predetermined arrangements (the "Specialty Hand").

To elevate the level of interest to progressive jackpot Blackjack players, the present invention provides for yet another playing method known as "Pay The Table"™. The eight decks of specially colour code cards used in this game is similar to those used in the Color It Up game. The major difference in Pay The Table is that at the start of each hand, each player puts a dollar into a progressive jackpot which may optionally be connected to other tables. If any player at the table gets a Specialty Hand, then every player at the table who played their dollar on that hand also wins money from the jackpot. In another embodiment of Pay The Table only players who played the dollar in the progressive jackpot may win Specialty Hands, and in doing so every player who played the side bet on that hand would also win from the jackpot.

It is an object of the present invention to provide an improved apparatus and method to enable casino card game players to participate in an electronic side bet progressive jackpot without the need to use tokens to indicate their intention to play.

It is another object of the present invention to provide an electronic bank for each casino game player.

It is yet another object of the present invention to provide a command centre key pad for use by casino game dealers to interact with the players and their banks by electronic means.

It is a further object of the present invention to provide a predetermined card. combination which employs colour-coded playing cards for playing conventional Blackjack.

It is yet a further object of the present invention to provide opportunities for all those who take part in a progressive jackpot at a given table to win, even if only one or some of the players at the table wins in accordance with a predetermined Specialty Hand arrangement.

Accordingly the present Invention provides an electronic side bet progressive jackpot gaming table apparatus comprising a color-coded player's banking centre, including a coin slot means, player electronic button means and associated digital display means; and a dealer key pad, said key pad providing a plurality of dealer electronic button means for a dealer to suitably operate a side bet progressive jackpot game.

The present invention further provides a method of playing a casino table card game using an electronic side bet progressive jackpot gaming table apparatus comprising the following sequential steps:

(a) players wager on a Blackjack game and make side bets for a progressive jackpot;

(b) the dealer starts the round of play by pressing a Start Hand button on a dealer's key pad;

(c) cards are dealt to all players who have made a wager and to the dealer;

(d) the hands of the players are finalised one at a time starting with the first player and proceeding sequentially therefrom;

(e) that player's wager is collected or winnings paid if it can be determined at that time whether the player has won or lost;

(f) the hand of the dealer is finalised once the hands of all the players have been finalized;

(g) each players wager is collected or winnings paid depending on whether the player has won or lost;

(h) a determination is made as to whether or not a winning combination hand has occurred during the round and any winners are paid according to the type of winning combination hand that has occurred; and (i) the dealer ends the round of play by pressing the End Hand button on the dealer's key pad.

The present invention also provides for a method of playing a casino Blackjack game, comprising the steps of:

(a) players position themselves at a gaming table with color-coded play stations;

(b) players wager on the Blackjack game and, optionally, make side bets for a progressive jackpot, (c) a dealer starts the round of play by dealing to each player cards from a combined deck of cards made up of a plurality of standard decks of playing cards except that each deck is of one color, with each said color matching that of the players station;

(d;) cards are dealt to all players who have made a wager and to the dealer;

(e) the hands of the players are finalised one at a time starting with the first player;

(f) that players wager is collected or winnings paid if it can be determined at that time whether the player has won or lost;

(g) the dealers hand is finalised once the hands of all the players have been finalized;

(h) each player's wager is collected or winnings paid depending on whether the player has won or lost; and (i) a determination is made as to whether or not a winning combination hand has occurred during the round and any winners are paid according to the type of winning combination hand that has occurred.

The present Invention further provides a method of playing a casino Blackjack game, comprising the steps of:

(a) players position themselves at a gaming table with color-coded play stations;

(b) players wager on the Blackjack game and, optionally, making side bets for the progressive jackpot;

(c) a dealer starts the round of play by dealing to each player cards from a combined deck of cards made up of a plurality of standard decks of playing cards except that each deck is of one color, with each said color matching that of the players station;

(d) cards are dealt to all players who have made a wager and to the dealer, (e) the hands of the players are finalised one at a time starting with the first player;

(f) that players wager is collected or winnings paid if it can be determined at that time whether the player has won or lost;

(g) the dealer's hand is finalised once the hands of all the players have been finalised;

(h) each player's wager is collected or winnings paid depending on whether the player has won or lost;

(i) a determination is made as to whether or not a winning combination hand has occurred during the round and any winners are paid according to the type of winning combination hand that has occurred; and (j) all other players who participated in the side bet jackpot are paid the same or a lesser amount as the player who was dealt the winning combination hand.

BRIEF DESCRIPTION OF THE DRAWINGS

In drawings which illustrate embodiments of the invention.

DESCRIPTION OF THE PREFERRED EMBODIMET

Figure 1:
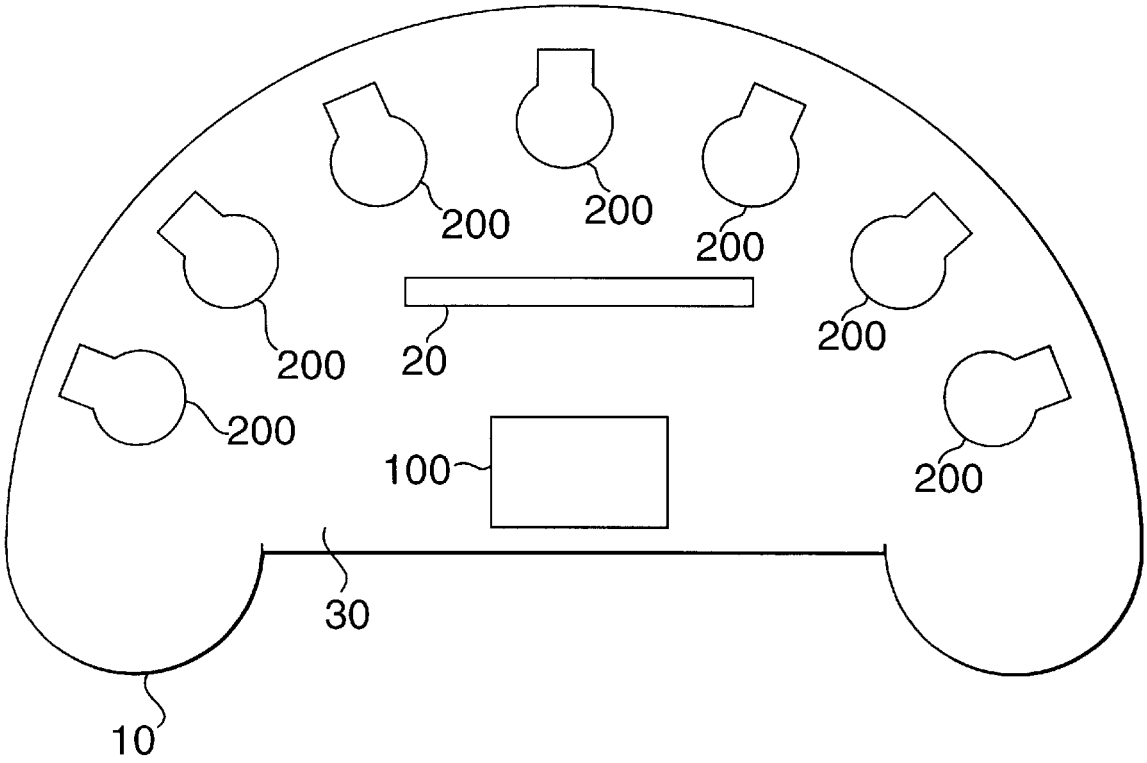
FIG. 1 is a diagrammatic plan view of a gaming table layout showing the players' banking centres, progressive jackpot display and dealers key pad of the present invention.

For this description of the preferred embodiment, the electronic side bet progressive jackpot apparatus of the present invention is used in conjunction with table card games known as "Color It Up" and "Pay The Table" as described below. However, the electronic side bet progressive jackpot apparatus disclosed herein can be played alone or with other casino games, and the present invention is not limited to use with the game disclosed in this description of the preferred embodiment.

Referring tog FIGS. 1 and 2, each player at a gaming table 10 has a colour-coded playing position with a corresponding colour-coed "player's banking centre" 200 below a wager area on the table layout. This players banking centre 200 is comprised of a three digit LED display 202, a coin slot 201 and a colored button 203 which matches the players colour on the table layout. The player's banking centre 200 is used in conjunction with the progressive side bet and not the player's wager against the house.

The player's banking centre's LED display 202 shows the current amount of money in that player's bank. There am three ways for money to be deposited in the player's bank (not shown). One way Is for the players to actually drop dollar coins into the coin slot 201 into their bank. The player may drop coins at any time during the game. For every dollar dropped, the dollar amount in the player's bank will increase by one dollar. The action of dropping coins by the player does not automatically qualify him for playing the progressive jackpot side bet.

The player may also choose to have the dealer deposit money Into his bank. The player would pass money and/or casino chips to the dealer and ask to have them deposited into his bank. Using a command centre key pad 100, the dealer would then deposit the corresponding amount into the player's bank. For every dollar deposited, the dollar amount in the player's bank will increase by one dollar. The action of depositing money by the dealer does not automatically qualify the player for playing the side bet.

Winning the Blackjack Specialty Hands or the regular hands is the third way money is deposited into the players bank. With respect to Specialty Hands, every time a same coloured Blackjack or matching coloured Blackjack (to be described in more detail later) is hit by a player, the corresponding payout is deposited into each players bank who has played the side bet. The dealer, using the key pad 100, would enter the Specialty Hand which was won. In turn, the system would deposit the appropriate winnings, deducted from the progressive jackpot, into the bank of each player who had played the side bet, all carried out electronically. For winnings on the regular hands, money is deposited into the player's bank in a similar fashsion.

According to the present invention, there are also three ways money is deducted from the player's bank. One way is by playing the side bet by pressing the colored button 203. Each time the side bet is played, one dollar is automatically deducted, by the system, from the players bank The system will deduct one dollar from the bank of each player playing the side bet every time the dealer presses a Start Hand button 103. Once the Start Hand button 103 has been pressed, the colored button 203 of each player who had played the side bet would be lit. To play the side bet, players must have at least one dollar in their bank The other two ways money is deducted from the player's bank are by the player choosing to withdraw money from his bank or cashing out entirely. A player may choose to withdraw any amount of money in his bank. The player would simply make this request to the dealer, who would perform the transaction using the key pad 100. The requested amount of money would be given to the player and automatically deducted from the players bank. A player may also choose to cash out his bank entirely. Once again this request is made to the dealer by the player. The dealer, using the key pad 100, would perform the transaction. The system would than reset the player's bank at zero amount.

As discussed earlier, another element of the player's bank is the player's colored button 203. Each playing position on the table has a corresponding colored button 203 forming part of the players banking centre 200. The colored button 203 is an indicator as to whether or not the side bet has been played by the player. The colored button is always in one of two modes: it is either lit, indicating the player is playing the side bet; or it is not lit, indicating the player is not playing the side bet.

If the player's colored button 203 is not lit, then that player is not playing in the side bet. The player may have money in his bank, and may play as many consecutive hands as he chooses without playing the side bet. No money will be deducted from or added to the player's bank when the side bet is not being played.

When the player's colored button 203 is lit, that player is playing the side bet. To light his colored button the player would be required to actually push his colored button. One of the unique feature of the present invention is that the player may press his colored button at any time. As soon as the colored button is pressed, the system will immediately acknowledge each press of the colored button, but, depending on the situation, may or may not take immediate action regarding that pressing action. Whether or not the Colored button lights up when pressed by the player depends on certain situations, including the time of the push, the amount of money in the player's bank, and the mode of the Colored button when pushed.

There are two Colored button modes when it is being pressed by a player:

Mode I—When there is no money in the player's bank—the player may press the Colored button but the system will take no action because the player's bank is empty. The button may be incorporated to flash, blink, beep or some other type of warning signal to alert the player when their players bank reaches zero.

Mode II—When there Is money in the players bank—the player presses the colored button and the system would acknowledge this push, but depending on the stage of the round, may or may not take immediate action regarding that press:

The system takes immediate action—if the player's push came after End Hand button 104 has been pushed by the dealer and before the Start Hand button 103 had been pushed. The system would simply change the mode, similar to turning a light switch on or off. If the colored button was already lit, it would be turned off. If the colored button was not lit, it would become lit, being turned on.

If the colored button 203 was turned on at the time of the push by the player, it would now be turned to the off mode. The system would turn off the player's colored button. No action toward the player's bank would be taken when the dealer presses the Start Hand button 103, but the system would lock out the player's colored button from playing the side bet on that particular hand. The player would not be involved in the side bet on that particular hand. Until the next action by the player occurs, the players Colored button would remain in the off mode.

If the colored button 203 was turned off at the time of the push by the player, it would now be turned to the on mode. The system would light the players Colored button immediately. When the dealer presses the Start Hand button 103, the system would lock in the player's colored button as playing the side bet on that hand, as well as automatically deducting a dollar from the player's bank. Until the next pressing action by the player occurs the players Colored button would remain in the on mode and each push of the Start Hand button would automatically deduct money from the player's bank until the player's bank became empty, thus the "continuous play" feature.

The system would acknowledge player's press but would delay any action—The system would acknowledge the player's push when the player has money in his bank, but take no immediate action on the push, if the player's push comes after the dealer pushed the Start Hand button 103 and before the dealer pushes the End Hand button 104. In other words this push by the player came during the playing of the round.

After the dealer pushes the End Hand button 104, the system would then take action on the push made by the player during the round. If the Colored button 203 was on at the time of the push by the player it would now be turned off. Until the next pressing action by the player occurs, the player's Colored button would remain in the off mode. If the Colored button was off at the time of the push by the player it would now be turned on. When the dealer presses the Start Hand button 103 a dollar would be deducted from the players bank Until the next pressing action by the player occurs, the players Colored button would remain in the on mode, and each push of the Start Hand button would automatically deduct money from the players bank until the player's bank becomes empty.

Figure 3:
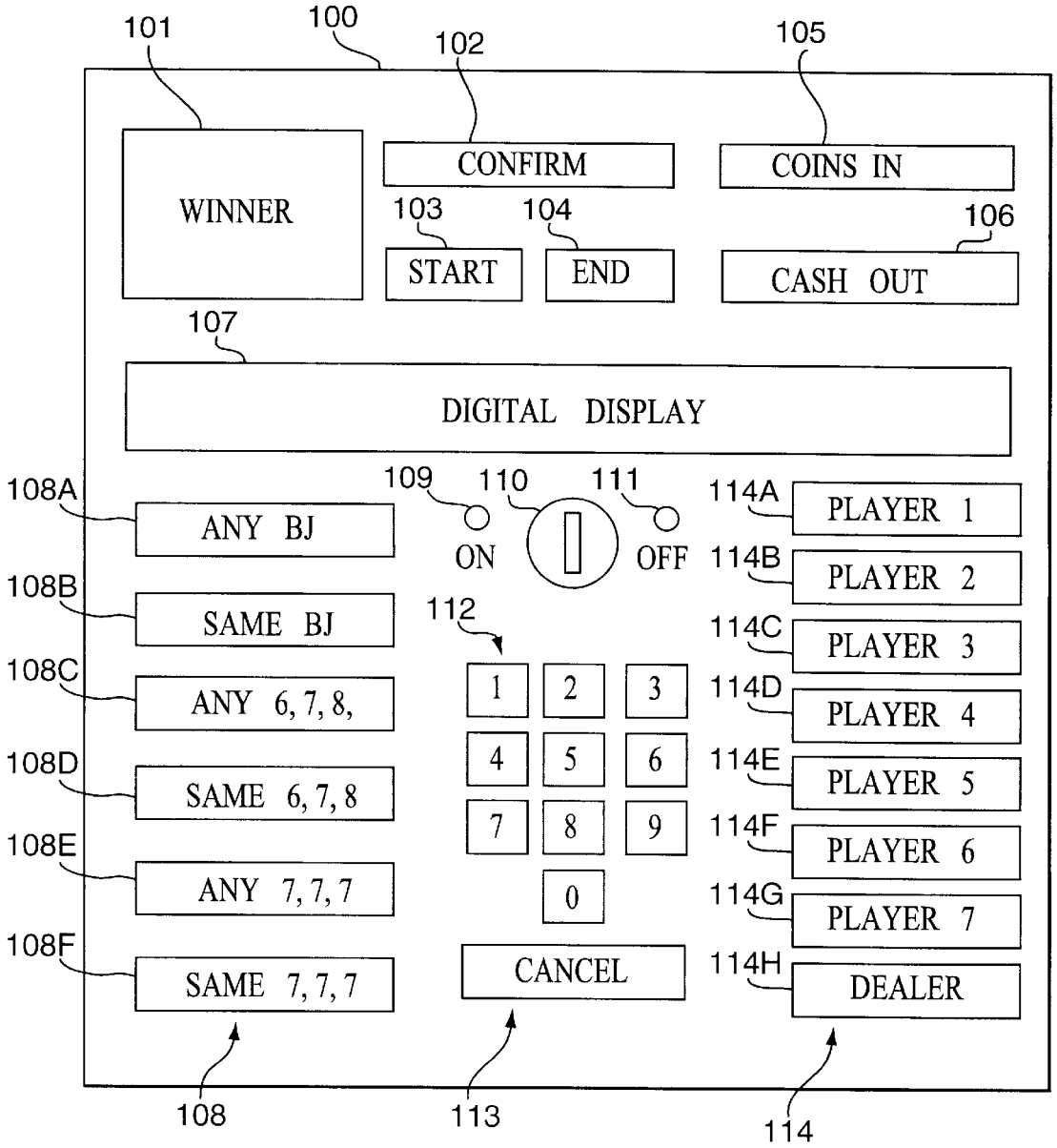
FIG. 3 shows a dealers command centre key pad of the present invention.

Referring to FIG. 3, in the electronic side bet progressive jackpot apparatus of the present invention, the dealer is provided with a command centre key pad 100. The pad is used when Specialty Winning Hands appear on the able. It is also used when players wish to cash in or out, and to start and end a hand.

The key pad 100 is turned on and off by a dealers key inserted in a key pad slot 110. The key would normally be in the off position when the table is not in use. Illumination of off light 111 indicates the table is not in use. When the table is functioning the key would be in the on position with on light 109 being lit.

When a Specialty Hand is hit by a player, the dealer need only press winner button 101, key in the number of starting hands that were in that round and the corresponding number of players who have made a side bet for that round, then corresponding Specialty Hand button 108 (more specifically, one of Specialty Hand buttons 108A to 108F), followed by Confirm Button 102. Depending on the kind of Specialty Hand being hit, a microprocessor or computer would add the winning amount to the bank of each player who had played the side bet on that hand, as well as deducting the proper dollar amount from the progressive jackpot.

When a player chooses to have the dealer deposit money in the player's bank, the dealer would press a Coins In button 105, enter the amount on numeric key pad 112, followed by pushing a Player's color button 114, and to confirm the transaction by pressing the Confirm button 102. The microprocessor or computer would than update the player's bank display to reflect the deposited amount Similarly, when a player chooses to cash out his bank, he has two options. He may choose to empty his entire bank. The dealer would press Cash Out button 106, the Player's Color button 114 (more specifically, one of the player's Color buttons 114A to 114H), followed by the Confirm button 102. Alternatively, the player may choose to withdraw an amount of money Ion than the amount in the bank The dealer would then press Cash Out button 106, enter the dollar amount the player wishes to withdraw, press the Players Color button 114 and then the Confirm button 102.

The Start Hand button 103 and the End Hand button 104 are used on every hand by the dealer. Before the dealer deals any cards to any player, and after all wagers and side bets are placed, the dealer would press the Start Hand button. Once the Start Hand button is pressed all side bets are locked in. Pressing the Start Hand button also will lock out any player who thereafter attempts to play the side bet on that particular hand. When a player presses his Colored button 203 after the Start Hand button 103 has been pressed, whether to play or not to play the side bet, the system will recognize the action by the player, but will not carry out that action until the End Hand button 104 is pressed. The system will also record the exact time the Start Hand button was pressed.

As suggested by the name, the End Hand button is used to register the end of the hand. The dealer would hit the End Hand button 104 as soon as he recognizes that no Specialty Hands have been hit at the table. After the End Hand button is pressed the system would then allow the players to turn the side bet ON or OFF. The system will always recognize the player's last action regarding the side bet.

The dealer's command centre key pad 100 is also provided with a Cancel button 113, which may be used to nullify any action by the dealer prior to the pressing of the Confirm button.

The Digital Display 107 on the key pad 100 can be a LED display. The digital display will prompt the dealer and display the end result of any action taken by the dealer, i.e. Coins In, Cash Out, etc.

Figure 2:
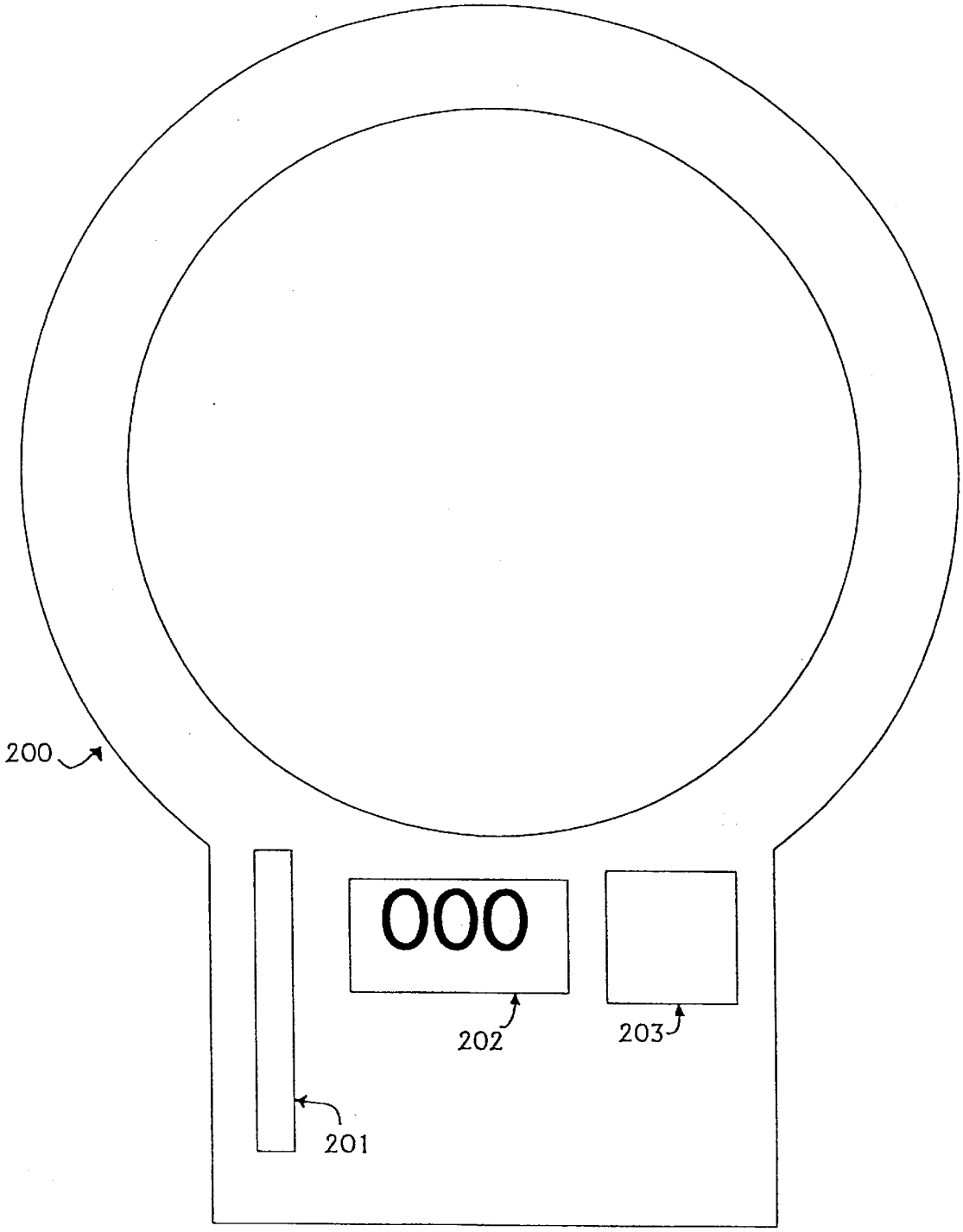
FIG. 2 is an enlarged view of a player's bank of the present invention.

In addition to the Digital Display provided on the dealers key pad 100, the apparatus according to the present invention also comprises a unique LED progressive jackpot display 20 located on the gaming table layout, directly in the players' line of vision (see FIG. 1).

The LED progressive jackpot display 20 can serve multiple purposes. The display can show the progressive jackpot total. It can also be used to scroll messages (e.g., Congratulations, Payouts, eta). The display can be used by the casino for both internal and external advertising.

The progressive jackpot may be built by a single table, a network of tables within the casino, or on a wide area progressive jackpot Systems. All Specialty Hands won at the tables are deducted from the progressive jackpot. The unwon portion will be accumulated in the jackpot.

In a typical game, the players wager on the casino game being played (Blackjack in the present embodiment) according to the rules of that casino game. Each player may also make a side bet. Initially, a player makes a side bet by activating the Colored button 203 by pressing it. The side bet can be withdrawn until it is "locked in" once play of the round starts. (If the button is pressed during the play of a round, the activation will be delayed until the end of the round and will take effect only in the next round of play). Once activated, the Colored button 203 will remain ON until the Player turns it OFF by pressing it again. Similarly, the Colored button 203 will remain OFF until the Player turns it ON by pressing it again. Once the Player presses the Colored button 203, the computer then either takes immediate action or delayed action (as described earlier).

The dealer starts the round of play by pressing the Start Hand button 103. The computer records into memory which players have made a side bet and a dollar is deducted from each of their player's banks for the side bet. A predetermined percentage of this amount, for example 80%, is added to the progressive jackpot and the remainder is taken by the house as revenue. Side bets are now locked in for this round and additional side bets are locked out until the next round.

The dealer then deals the cards and resolves winners and losers of each hand, paying winners and collecting the wagers of losers. During this phase, the dealer notes whether any Specialty Hands have occurred.

The payout of the side bet will be described hereinafter with reference to a shared jackpot payout game such as Pay the Table. If a Specialty Hand has occurred, then the players who have made a side bet (Qualifying Players) for this round are entitled to be paid an amount determined from the Specialty Hand payout schedule (discussed below). This money comes from the jackpot. The dealer effects the payout, if a Specialty Hand has occurred, by pressing the Winner button 101; inputting the number of starting hands: Identifying the number of Qualifying Players using the numeric key pad 112; identifying the Specialty Hand which has occurred by using the Specialty Hand buttons (108A to 108F); and pressing the Confirm button 102. The computer then uses the Specialty Hand payout schedule and the number of Qualifying Players to determine a payout amount to each Qualifying Player. If the payout amount is less than a predetermined amount, for example $500, the computer deposits that amount directly into the Player's bank of each Qualifying Player. If the amount exceeds the predetermined amount or the total of a Qualifying Players balance and the payout amount exceeds a predetermined limits for example $999, then the dealer is instructed via Digital Display 107 on key pad 100 to make the payout manually. The computer then deducts the total amount of the winning payouts from the progressive jackpot. In the exceptional situation where more than one Specialty Hand occurs during a round, the payout amount is the largest payout from any single Specialty Hand. A similar procedure with appropriate modifications is followed in games without a shared jackpot.

The Dealer ends the round of play by pressing the End Hand button 104. The computer system then dears the memory of all players who have made a side bet. The computer system also executes any delayed side bet actions as previously described.

The method of playing the "Color It Up" Blackjack game can be described as follows, The game consists of up to seven players and a dealer who deals the cards for the house. It may be played with four or more decks of special playing cards. The game is best played with seven or eight decks of cards. The more decks used in Color It Up, the better the house odds and the higher the payouts to the players.

The faces of the special playing cards are the same as a standard deck of playing cards, however each deck used is a separate color. To further explain this, each deck of fifty-two cards are entirely one color on the face side. The colors could be any color, but would match the colors on the table adjacent the respective player positions. For example, there can be eight colors on the table, namely red, green, blue, yellow, black, purple, brown and orange. Whereas a standard deck of playing cards would include black spades and clubs, and red hearts and diamonds, the cards in the blue deck according to this invention would all be blue, and be all yellow in the yellow deck, all green in the green deck, and so forth.

The game Color It Up is played on a Color It Up table. The table consists of seven betting areas, one for each player who may play the game. Each player's betting area is denoted by a different color. The decks of playing cards and the colors on the playing table must match.

During the game, each player places a wager in their colored square on the table layout. Like traditional Blackjack each player has a location in front of them where they place their bets. Each location occupies a color for up to seven colors. Accordingly, there are seven different colored spaces on the table layout. After all players make their wagers the dealer will deal the cards. The deal is from the dealer's left to his right and then his own card, then a second card to each player and the dealer, as in traditional Blackjack. The game may be played with the players' cards face up or face down. The dealer will flip one of his two cards face up for all players to see. The player to the dealers left will either stand or hit (take another card). The player is playing his hand against the dealer, who is playing his hand against all the players on the table. The object is to be the closest to 21 without going over, which is called busting. Aces may be designated as one or eleven. If a player busts he automatically loses his wager to the house. After all players have played their hands the dealer flips his second card face up and plays his hand. The dealer must hit until he has 17 or more and must stay after reaching any total of 17 or more. Some casinos may choose to stay on a soft 17, i.e. a hand including an ace which can total either 7 or 17, but this must be stated clearly on the Color It Up table. If the dealer beats or ties the player's hand in Color It Up the dealer wins the players wager. If the player's hand beats the dealer's hand than the player wins. Blackjacks (a two card 21 in the players first two cards) pays 3 to 2. If the player wins, the casino pays the player's wager. The player may receive bigger payoffs for making certain Specialty Hands. These Specialty Hand combinations win regardless of whether the dealer beats the player or not. Casinos may stipulate various other playing rules such as doubling down, or splitting of certain hands.

The payoffs may vary from each casino and depend on the number of decks being used in the game. All payoffs are on the players original hand, and do not count on split hands. The player wins their wager if they tie (push) or lose against the house's hand on any of the specialty winning hands. In other words, according to the present invention, all Specialty winning Hands are automatic winners. The following is a list of Specialty winning Hands and typical payoffs which may vary from casino to casino:

| Specialty winning Hands | Payout to one player |
|---|---|
| Any same colored Blackjack | 10 |
| Player's same colored Blackjack - Ace & King, Queen or Ten | 25 |
| Player's same colored Blackjack - Ace & Jack | 50 |
| Six, Seven, Eight - any same color | 100 |
| Six, Seven, Eight - player's same color | 200 |
| Three Sevens - any same color | 200 |
| Three Sevens - player's same color | 500 |
| Four Five's - any same color | 1000 |
| Four Five's - player's same color | 2000 |

The following Example serves to illustrate the operation of a Specialty winning Hand:

A player playing the Green space wagers $10 per hand. If that player is dealt a Red ace and a Green king in his first two cards, this is only a Blackjack and pays 3 to 2 ($15). If the ace was also Green in this example then he would have had a "player's same color Blackjack" Special winning Hand. This would pay 25 to 1 ($250). If the Green player had received a Red ace and Red jack, this would have paid 10 to 1 ($100). If, on another hand, the same Green player gets a Six, Seven and Eight for 21, and if the three cards are the same color he would win 100 times his wager, unless they were Green, in which case he would win 200 times his wager.

With respect to the game "Pay The Table", it can be described as follows.

Pay The Table is played on a specially designed Pay The Table table. Preferably, the game also uses eight decks of specially colored playing cards similar to those used in the Color It Up card game. The most significant difference in Pay The Table is that, at the start of every hand, each player puts a dollar into a progressive pat which is connected to other tables. If any player at the table gets a Specialty Hand, then every player at the table who paid a dollar on that hand into the progressive pot also wins money from the jackpot, hence the name "Pay The Table".

Up to seven players may play at a Pay The Table table at one time. The table has a different colored betting square for each player. This square is where each player would place his wager at the start of each hand. The table is equipped with a player's banking centre according to the present invention. Players press their own Colored button to take part in the progressive side bet, at which time, a dollar will be deducted from that player's bank after the dealer presses the Start Hand button 103. A percentage of this dollar is then registered in the progressive jackpot The following is a list of Specialty winning Hands for Pay The Table and typical payoffs which may vary from casino to casino:

| Specialty winning Hands Payoff | Table Wins |
|---|---|
| Three same colored Sevens - matching player's color | Jackpot |
| Any three same colored Sevens | 1000 Each |
| Same colored 6, 7, 8 - matching player's color | 500 Each |
| Any same colored 6, 7, 8 | 250 Each |
| Same colored Blackjack - matching player's color | 50 Each |
| Any same colored Blackjack | 10 Each |

These payouts may vary slightly depending on the casino, but will remain constant for each table connected to the same progressive jackpot At the start of a hand each player places a bet in their betting place on the table. Players also press their colored button if they wish to participate in the progressive jackpot. The dealer then deals two cards to each player, as well as to himself. The dealer has one card face up and one face down, so the players only see one dealer card. As in traditional Blackjack, the players then each play their hand starting with the player on the dealer's left. The object in Blackjack is to be closer to 21 than the dealer, without going over 21 (busting). Players may split cards of equal value and double down as long as these plays follow the posted casino rules. After the players have all played their hands, the dealer then flip his hole card. If the dealer has less than 17, the dealer must keep taking cards until a hand of 17 or more is made. If the dealer's hand goes over 21, then all players who did not bust, automatically win their hands. Some casinos will hit a soft 17 hand. This will be posted at the table if the casino requires the dealer to hit soft 17, or whether he must stand on any 17. The casino then pays or collects each player's bet, depending on who won or lost the hand. If there is a push the player keeps his wager. A two card Blackjack usually pays 3 to 2.

If any player at the table hits a Specialty Hand, then every player at the table who entered the progressive jackpot also wins. Depending on the Specialty Hand that is hit, players may win from $10 to the jackpot amount. If the jackpot is won then every participating player at the table splits the jackpot equally.

For both Color It Up and Pay The Table, the payout schedules on the table are minimum payouts. This will be stated on the gaming table. With the exception of the jackpot Specialty Hand (three same colored Seven in the player's colour), the winning schedule of the other five Specialty Hands is derived using the formula: (Specialty Hands winning payoff ×7)+number of participating hands at table (excluding dealers hand). In the case of the jackpot Specialty Hand, the jackpot will be split equally among the players at the table who played with the side bet on that particular hand. The aforementioned winning formula is designed so that players would not be required to play at a full table to take advantage of the odds in the game. Rather, all payoffs are based on the actual number of starting hands dealt at the table, minus that of the dealers.

The following Tables illustrate the payout schedules according to the five Specialty Hands:

Any Same Colored Blackjack

| | Players At Table (not including dealer) | | | | | | |
|---|---|---|---|---|---|---|---|
| Coins In | 1 player | 2 players | 3 players | 4 players | 5 players | 6 players | 7 players |
| 0 | 0 | 0 | 0 | 0 | 0 | 0 | 0 |
| 1 | 70 | 35 | 24 | 18 | 14 | 12 | 10 |
| 2 | — | 35 | 24 | 18 | 14 | 12 | 10 |
| 3 | — | — | 24 | 18 | 14 | 12 | 10 |
| 4 | — | — | — | 18 | 14 | 12 | 10 |
| 5 | — | — | — | — | 14 | 12 | 10 |
| 6 | — | — | — | — | — | 12 | 10 |
| 7 | — | — | — | — | — | — | 10 |

Matching Blackjack

| | Players At Table (not including dealer) | | | | | | |
|---|---|---|---|---|---|---|---|
| Coins In | 1 player | 2 players | 3 players | 4 players | 5 players | 6 players | 7 players |
| 0 | 0 | 0 | 0 | 0 | 0 | 0 | 0 |
| 1 | 350 | 175 | 117 | 88 | 70 | 59 | 50 |
| 2 | — | 175 | 117 | 88 | 70 | 59 | 50 |
| 3 | — | — | 117 | 88 | 70 | 59 | 50 |
| 4 | — | — | — | 88 | 70 | 59 | 50 |
| 5 | — | — | — | — | 70 | 59 | 50 |
| 6 | — | — | — | — | — | 59 | 50 |
| 7 | — | — | — | — | — | — | 50 |

Same Colored 6, 7, 8

| | Players At Table (not including dealer) | | | | | | |
|---|---|---|---|---|---|---|---|
| Coins In | 1 player | 2 players | 3 players | 4 players | 5 players | 6 players | 7 players |
| 0 | 0 | 0 | 0 | 0 | 0 | 0 | 0 |
| 1 | 1750 | 875 | 584 | 438 | 350 | 291 | 250 |
| 2 | — | 875 | 584 | 438 | 350 | 291 | 250 |
| 3 | — | — | 584 | 438 | 350 | 291 | 250 |
| 4 | — | — | — | 438 | 350 | 291 | 250 |
| 5 | — | — | — | — | 350 | 291 | 250 |
| 6 | — | — | — | — | — | 291 | 250 |
| 7 | — | — | — | — | — | — | 250 |

| Matching 6, 7, 8 | | | | | | | |
|---|---|---|---|---|---|---|---|
| | Players At Table (not including dealer) | | | | | | |
| Coins In | 1 player | 2 players | 3 players | 4 players | 5 players | 6 players | 7 players |
| 0 | 0 | 0 | 0 | 0 | 0 | 0 | 0 |
| 1 | 3500 | 1750 | 1167 | 875 | 700 | 584 | 500 |
| 2 | — | 1750 | 1167 | 875 | 700 | 584 | 500 |
| 3 | — | — | 1167 | 875 | 700 | 584 | 500 |
| 4 | — | — | — | 875 | 700 | 584 | 500 |
| 5 | — | — | — | — | 700 | 584 | 500 |
| 6 | — | — | — | — | — | 584 | 500 |
| 7 | — | — | — | — | — | — | 500 |

| Same Colored 7, 7, 7 | | | | | | | |
|---|---|---|---|---|---|---|---|
| | Players At Table (not including dealer) | | | | | | |
| Coins In | 1 player | 2 players | 3 players | 4 players | 5 players | 6 players | 7 players |
| 0 | 0 | 0 | 0 | 0 | 0 | 0 | 0 |
| 1 | 7000 | 3500 | 2334 | 1750 | 1400 | 1167 | 1000 |
| 2 | — | 3500 | 2334 | 1750 | 1400 | 1167 | 1000 |
| 3 | — | — | 2334 | 1750 | 1400 | 1167 | 1000 |
| 4 | — | — | — | 1750 | 1400 | 1167 | 1000 |
| 5 | — | — | — | — | 1400 | 1167 | 1000 |
| 6 | — | — | — | — | — | 1167 | 1000 |
| 7 | — | — | — | — | — | — | 1000 |

With the exception of the jackpot, all other payoffs are calculated by the computer system using the aforesaid formula. These payoffs show on the digital display of the dealer's key pad as well as the LED Display on the table centre. After the dealer keys the required information Into the key pad, the specific payout is paid to the players at the table, by the dealer. Preferably, for the Any Same Colored Blackjack, the winning amount would be credited to the players' bank by the dealer using the latter's key pad.

When the jackpot is won, every player at the table who took part in the side bet is an automatic winner from the progressive jackpot. The entire jackpot is split evenly between these players, and is not based on the total hands at the table, as is the case with the other Specialty Hands.

All Specialty Hands are paid automatically from the progressive jackpot. However, the player's may still lose or push their wager with the casino. The Specialty Hand payoffs are not paid out after splitting of the players original hand, except in the rare situation where a player has two Same Colored Sevens and it is in the players best interests to split the Sevens. If the first card drawn to the split hand is the Seven needed to complete the Specialty Hand, this would still be a legal winning hand for the table, for the reason that a player should never be penalized, in the playing of his or her hand, when it comes to Specialty Hands.

If the house shows an ace, asks for insurance, and has a Blackjack, the hand is over even though a potential Specialty Hand may have existed at the table (i.e. two same colored Sevens in one hand). However, a Specialty Blackjack here would still be a Winning hand from the progressive jackpot. Players are required to give proper hit and stand signals when a Specialty Hand exists at the table. All exposed cards shall be burnt (i.e. discarded).

I claim:

1. A method of playing a casino Blackjack game, comprising the steps of:

(a) players position themselves at a gaming table with play stations, each of which play station is identified by a different color;

(b) players wager on the Blackjack game and, optionally make additional bets for a progressive jackpot;

(c) a dealer starts the round of play by dealing to each player cards from a combined deck of cards made up of a plurality of standard decks of playing cards except that each deck is of a different color, with all suits in each deck having one color and each said color matching that of a respective player's station;

(d) cards are dealt to all players who have made a wager and to the dealer;

(e) the hands of the players are finalised one at a time starting with the first player;

(f) that player's wager is collected or winnings paid if it can be determined at that time whether the player has won or lost;

(g) the dealer's hand is finalised once the hands of all the players have been finalized;

(h) each player's wager is collected or winnings paid depending on whether the player has won or lost; and (i) a determination is made as to whether or not a specialty hand has occurred during the round and any winners are paid according to the type of specialty hand that has occurred.

2. A method of playing a casino Blackjack game according to claim 1, wherein the number of standard decks of same colored playing cards is six or eight.

3. A method of playing a casino Blackjack game according to claim 2, wherein the payout for said winning combination hand in step (i) is as follows:

| Payout to one player | |
|---|---|
| Any same colored Blackjack | 10 |
| Player's same color Blackjack - Ace & King, Queen or Ten | 25 |
| Player's same color Blackjack - Ace & Jack | 50 |
| Six, Seven, Eight - any same color | 100 |
| Six, Seven, Eight - player's same color | 200 |
| Three Sevens - any same color | 200 |
| Three Sevens - player's same color | 500 |
| Four Five's - any same color | 1000 |
| Four Five's - player's same color | 2000. |

4. A method of playing a casino Blackjack game, comprising the steps of:

(a) players position themselves at a gaming table with play stations, each of which play station is identified by a different color;

(b) players wager on the Blackjack game and, optionally make additional bets for a progressive jackpot;

(c) a dealer starts the round of play by dealing to each player cards from a combined deck of cards made up of a plurality of standard decks of playing cards except that each deck is of a different color, with all suits in each deck having one color and each said color matching that of a respective player's station;

(d) cards are dealt to all players who have made a wager and to the dealer;

(e) the hands of the player's are finalised one at a time starting with the first player;

(f) that player's wager is collected or winnings paid if it can be determined at that time whether the player has won or lost;

(g) the dealer's hand is finalised once the hands of all the players have been finalized;

(h) each player's wager is collected or winnings paid depending on whether the player has won or lost; and (i) a determination is made as to whether or not a specialty hand has occurred during the round and any winners are paid according to the type of specialty hand that has occurred; and (j) all other player's who participated in the additional bet jackpot are paid the same or a lesser amount as the player who was dealt the winning combination hand.

5. A method of playing a casino Blackjack game according to claim 4, wherein the number of standard decks of same colored playing cards is six or eight.

6. A method of playing a casino Blackjack game according to claim 5, wherein, if the player's winning hand at step (i) entitled him to win the jackpot, then said jackpot will be divided equally for pay out at step (j).

7. A method for playing a casino Blackjack game according to claim 6, wherein said winning combination hand in step (i) comprises:

| Table Wins | |
|---|---|
| Three Same Colored Sevens - matching player's color | Jackpot |
| Any three Same Color Sevens | 1000 Each |
| Same Colored 6, 7, 8 - matching player's color | 500 Each |
| Any Same Colored 6, 7, 8 | 250 Each |
| Same Colored Blackjack - matching player's color | 50 Each |
| Any same Colored Blackjack | 10 Each. |

8. A method of playing a casino Blackjack game according to claim 7, wherein the number of players is seven or less.

9. A method of playing a casino Blackjack game according to claim 8, wherein the payout schedules on the table are minimum payouts in accordance with the formula:

(winning hand payoff×7)÷number of hands at the table (excluding dealer's hand), with the provision that said formula does not apply to a jackpot winning hand, in which case the jackpot is divided equally amongst all additional bet players.

10. A method for playing a casino Blackjack game according to claim 9, wherein the jackpots are connected to other tables playing a Blackjack game having the same or similar rules, elsewhere within and/or outside the casino facilities.

* * * * *